US007810675B2

(12) United States Patent
Wheatley

(10) Patent No.: US 7,810,675 B2
(45) Date of Patent: Oct. 12, 2010

(54) LINERS FOR AEROSOL PACKAGES AND ARTICLES COMPRISING SAME

(75) Inventor: Timothy Collin Wheatley, Beverly, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 12/770,474

(22) Filed: Apr. 29, 2010

(65) Prior Publication Data

US 2010/0206912 A1 Aug. 19, 2010

Related U.S. Application Data

(63) Continuation of application No. 11/724,710, filed on Mar. 16, 2007, now abandoned.

(60) Provisional application No. 60/785,865, filed on Mar. 24, 2006.

(51) Int. Cl.
*B65D 83/62* (2006.01)

(52) U.S. Cl. ..... 222/95; 222/105; 222/402.1

(58) Field of Classification Search ..... 222/95, 222/105, 402.1

See application file for complete search history.

(56) References Cited

U.S. PATENT DOCUMENTS

| | | | | |
|---|---|---|---|---|
| 3,477,195 | A | 11/1969 | Chambers | |
| 4,117,951 | A | 10/1978 | Winckler | |
| 4,346,743 | A | 8/1982 | Miller | |
| 5,234,137 | A | 8/1993 | Meuresch et al. | |
| 5,265,765 | A | 11/1993 | Maier | |
| 6,073,805 | A * | 6/2000 | Gueret | 222/95 |
| 6,092,566 | A * | 7/2000 | Yazawa et al. | 222/389 |
| 6,196,275 | B1 | 3/2001 | Yazawa | |
| 6,439,430 | B1 | 8/2002 | Gilroy et al. | |
| 2007/0145079 | A1 | 6/2007 | Casamento et al. | |

FOREIGN PATENT DOCUMENTS

| | | |
|---|---|---|
| EP | 0 972 723 B1 | 3/2003 |
| GB | 2 089 897 A | 6/1982 |

* cited by examiner

*Primary Examiner*—Kenneth Bomberg
(74) *Attorney, Agent, or Firm*—Ronald T. Sia; Kevin C. Johnson; Steven W. Miller

(57) ABSTRACT

Liners for use within aerosol containers are provided. In accordance with one exemplary embodiment, a liner includes a body having a first closed end and an opposing second end; a flange disposed proximate the opposing second end; and a neck intermediately disposed between the body and the flange. The neck comprises a shoulder for interaction with a valve cup upon assembly of the liner with an aerosol container and a valve cup.

7 Claims, 5 Drawing Sheets

LINERS FOR AEROSOL PACKAGES AND ARTICLES COMPRISING SAME

CROSS REFERENCE TO RELATED APPLICATIONS

This application is a continuation of U.S. patent Ser. No. 11/724,710 filed Mar. 16, 2007 now abandoned, which claims the benefit of U.S. Provisional Application Ser. No. 60/785,865, filed Mar. 24, 2006.

FIELD OF THE INVENTION

The present invention relates to liners for use within aerosol containers, and to articles comprising such liners.

BACKGROUND OF THE INVENTION

It is known to employ a flexible liner within aerosol containers. Compositions to be dispensed by the aerosol containers reside within the flexible liner. A propellant is injected into the container, which surrounds the flexible liner to aid in the dispensing of the composition. The propellant further aids to collapse the flexible liner upon composition usage, so that there is complete or near complete exhaustion of the composition.

In a typical manufacturing sequence, the flexible liner and container are separately manufactured and then pre-assembled. A valve cup is then inserted into an opening of the container and a neck region of the liner, and thereafter sealed to the container. A composition is then charged into the liner. The flexible liner may employ a flange that overhangs a rim (or can curl) defined at the container opening to prevent the flexible liner from falling into the container prior to complete assembly and product charging. This flange however, and more particularly its position on the container rim, can interfere with a proper seal between the valve cup and the container. An improper seal can lead to a portion of the composition leaking from the container. Such leakage is undesirable for a number of reasons, including creating an unwanted housekeeping issue and wasting an amount of composition that could otherwise be used in its intended manner.

Applicant accordingly has identified the need for a design improvement.

SUMMARY OF THE INVENTION

The present invention provides liners for use within aerosol containers. In accordance with one exemplary embodiment, there has now been provided a liner comprising a body including a first closed end and an opposing second end; a flange disposed proximate the opposing second end; and a neck intermediately disposed between the body and the flange. The neck comprises a shoulder for interaction with a valve cup upon assembly of the liner with an aerosol container and a valve cup.

The present invention further provides aerosol packages. In accordance with one exemplary embodiment, there has now been provided an aerosol package comprising an aerosol container and the above-described liner. In accordance with another exemplary embodiment, there has now been provided an aerosol package comprising an aerosol container including a first closed end and an opposing second end, the opposing second end being configured to receive a valve cup; a liner disposed within the aerosol container, the liner comprising a liner body, a liner neck extending from the liner body, and a liner flange disposed about a distal portion of the liner neck, at least a portion of the liner neck being disposed within the container second end; and a valve cup disposed within the liner neck. At least one of the liner neck and the valve cup comprises a radially extending member, so that the at least one of the liner neck and the valve cup can interact with the other of the liner neck and the valve cup sufficiently to reposition a portion of the liner upon assembling the valve cup, the liner, and the aerosol container.

The present invention also provides methods for assembling aerosol packages. In accordance with one exemplary embodiment, there has now been provided a method comprising the following steps: (a) providing a sub-assembly comprising an aerosol container and a liner disposed therein, i) the aerosol container comprising an opening on one end that is defined by a circumferentially extending wall and a rim disposed at a distal portion thereof; ii) the liner comprising a liner body, a liner neck extending from the liner body, and a liner flange disposed about a distal portion of the liner neck, wherein the liner neck is disposed adjacent or radially inward of the circumferentially extending wall and the liner flange is disposed at a first position about the rim; (b) providing a valve cup comprising a cup bottom, a cup top, and a valve cup flange extending from the cup top; (c) displacing the liner flange away from the first position about the rim; (d) inserting the valve cup into the liner and the aerosol container opening; and (e) joining the valve cup flange with the aerosol container rim.

BRIEF DESCRIPTION OF THE DRAWINGS

While the specification concludes with claims particularly pointing out and distinctly claiming the subject matter which is regarded as forming the present invention, it is believed that illustrative embodiments of the present invention may be better understood from the following description taken in conjunction with the accompanying drawings, in which:

DETAILED DESCRIPTION OF THE INVENTION

It is to be understood that the scope of the claims is not limited to the specific articles, devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural.

The term "fatty," as used herein, means a hydrocarbon chain having 12-22 carbon atoms (C12-22), preferably 14-18 carbon atoms (C14-18). The chain may be straight or branched and may be saturated or unsaturated (typically one or two double bonds in the chain). The term "water dispersible," as used herein, means that a substance is either substantially dispersible or soluble in water.

Figure 1:
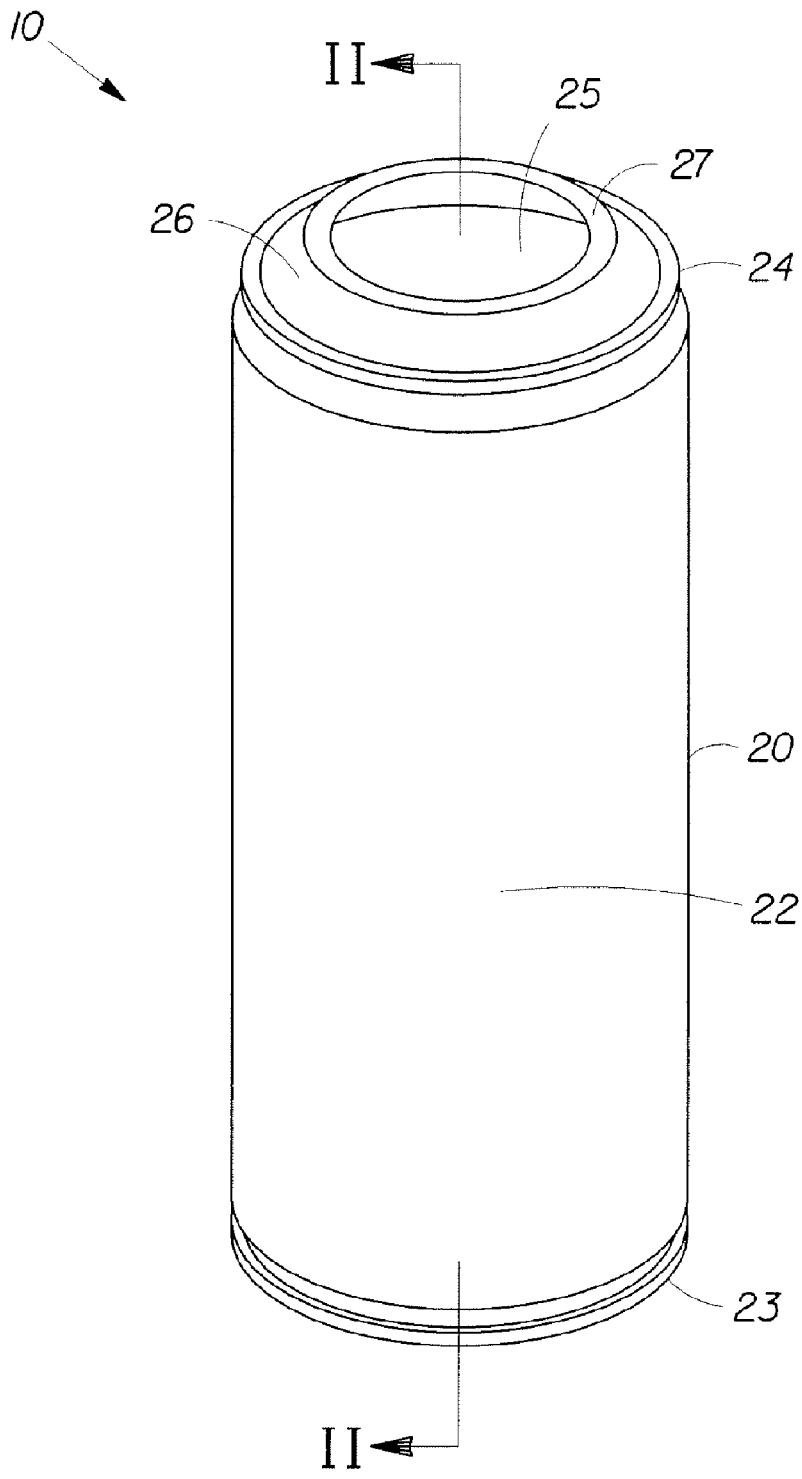
FIG. 1 is a perspective view of an exemplary aerosol package sub-assembly including an aerosol outer container and a liner disposed therein.
Figure 2:
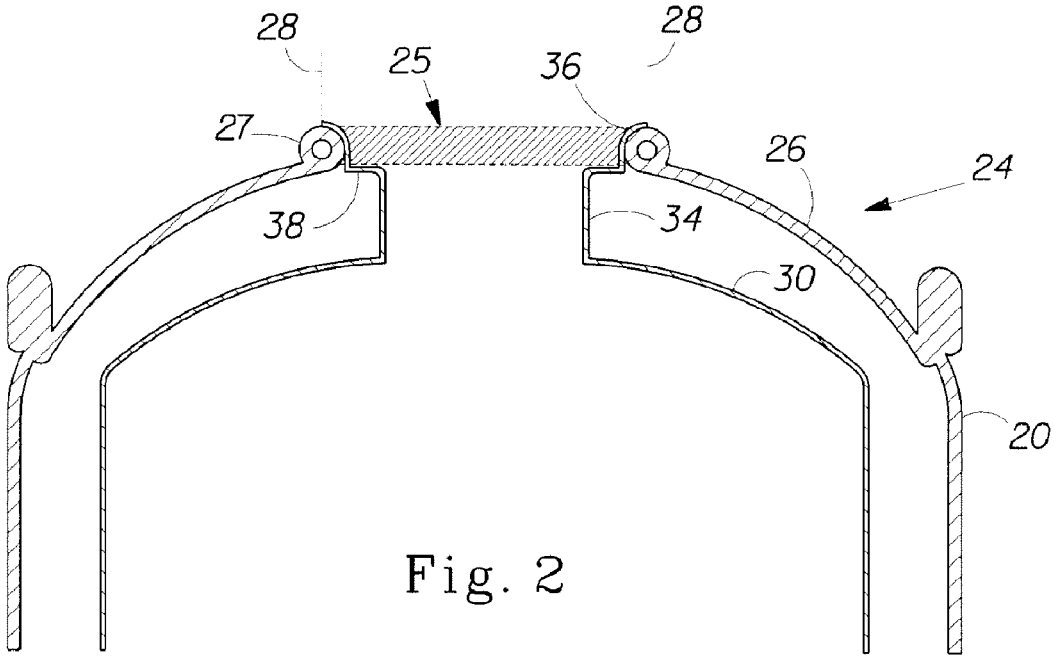
FIG. 2 is a partial cross-sectional view of the aerosol package sub-assembly of FIG. 1 taken through line II-II.

The present invention is directed to liners and aerosol packages comprising such liners. Referring now to the drawings, and more particularly to FIGS. 1 and 2, an exemplary aerosol package sub-assembly 10 is shown comprising an aerosol container 20 and a liner 30. Container 20 comprises a body 22, a bottom end closure 23, and a top end 24. Top end 24 has an opening 25 defined by a circumferentially extending wall 26 and a terminally positioned rim 27. Top end 24 may be integrally formed with body 22, or may alternatively be formed separately as a lid and then joined (e.g., seamed) to body 22. Container 20 may be made from any number of materials, including, for example, steel, aluminum, and alloys comprising either of these metals. In one exemplary embodiment, container 20 is rolled and seamed from a section of steel sheet stock. Although container 20 is shown in the form of a cylinder, other shapes are equally suitable.

Figure 3:
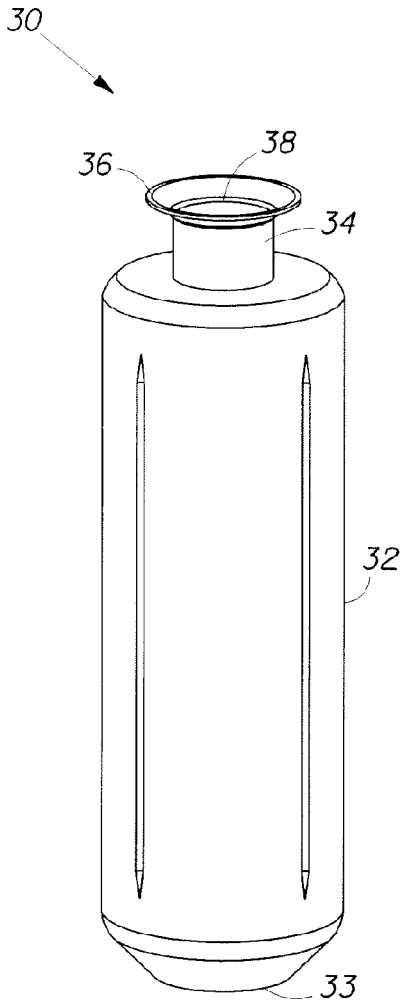
FIG. 3 is a perspective view of an exemplary liner according to the present invention.

With reference to FIGS. 2 and 3, an exemplary liner 30 is illustrated having a body 32 with a bottom closed end 33, a neck 34 extending from body 32, and a flange 36 disposed about a distal portion of neck 34. A shoulder 38 is defined in neck 34, and will be discussed in further detail below. Liner 30 can be made from a variety of generally flexible materials, including thermoplastic materials, such as, for example, nylon, polyethylene, polypropylene, polyethylene terephthalate (PET), and blends thereof. Liners of the present invention may be manufactured using methods known by the skilled artisan, including, for example, blow-molding, thermoforming, injection molding, and the like. Shoulder 38 may be formed in neck 34 before, during, or after forming the remaining features of the liner. The liners may comprise pleats, ribs, scores, indentations, varying wall thicknesses, and other features to facilitate collapse upon exhaustion of its contents. Such collapse may be, for example, in a radial direction, in an axial direction, or in both directions. The liners may alternatively be designed so as not to substantially collapse upon exhaustion of its contents.

Liner 30 can be inserted into container 20 through the bottom end prior to attaching bottom closure 23, or through the top end 24 via opening 25. As can be seen in FIG. 2, liner flange 36 is placed at a first position 28 about rim 27. Accordingly, liner 30 hangs by its flange 36 after it is placed into container 20. Flange 36 helps prevent liner 30 from falling further into container 20 before a valve cup is inserted into opening 25 and a product is charged into liner 30.

Figure 4:
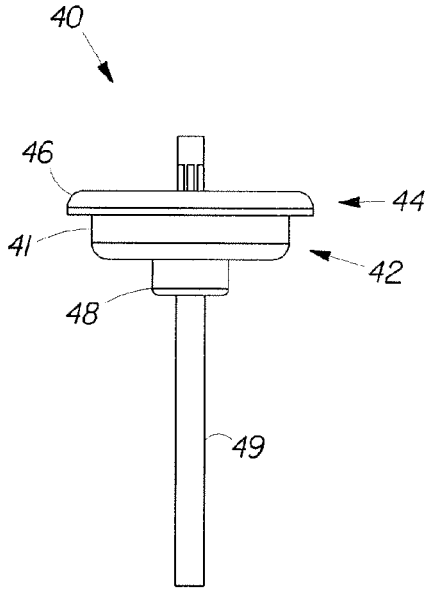
FIG. 4 is a an elevation view of an exemplary valve cup sub-assembly that is capable of being assembled with the aerosol package sub-assembly shown in FIG. 1.

Referring now to FIG. 4, an exemplary valve cup assembly 40 is shown comprising a valve cup 41 having a cup bottom 42, a cup top 44, and a cup flange 46 extending from cup top 44. Valve cup assembly 40 is shown further comprising a valve 48 and valve stem 49 extending therefrom. A gasket (not shown) may optionally be associated with flange 46 to improve a seal formed between valve cup assembly 40 and container 20. Valve cup 41 can be made from any number of materials, including metals and thermoplastics. Valve cup 41 is preferably made from tinplate steel.

Figure 5:
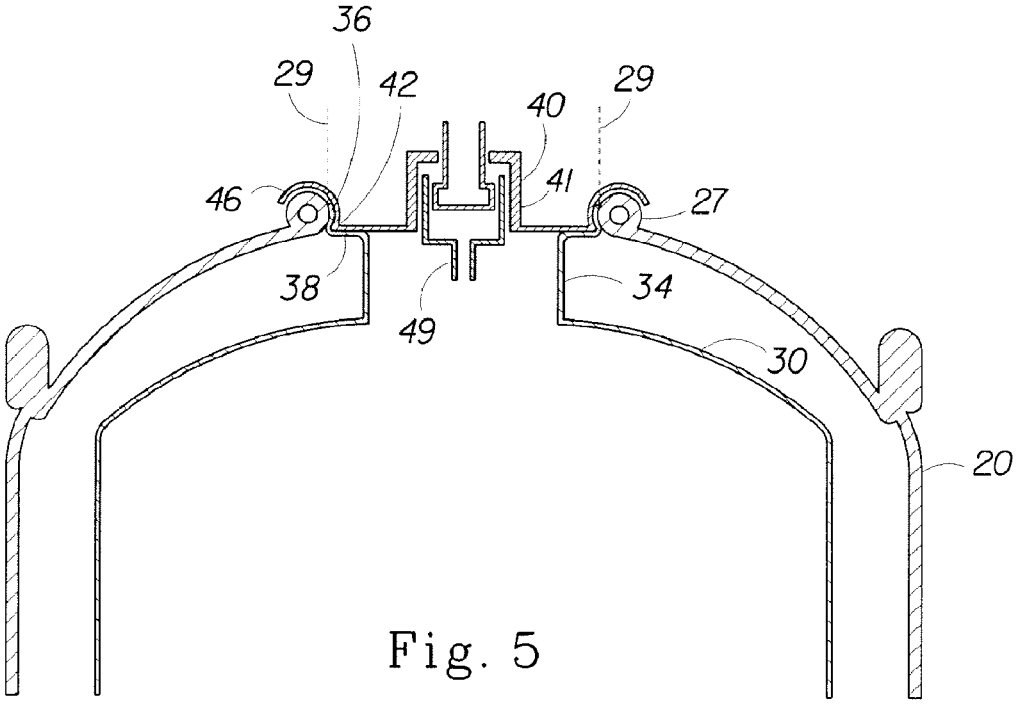
FIG. 5 is a partial cross-sectional view of the embodiments of FIGS. 1 and 4 after their assembly.

FIG. 5 illustrates valve cup assembly 40 joined with the container 20 and liner 30 sub-assembly 10. As noted above, liner 30 comprises a shoulder 38 defined in neck 34. When valve cup assembly 40 is inserted into container opening 25, the cup bottom 42 contacts shoulder 38 to reposition (displace or move) liner flange 36 from its initial position 28 (as shown in FIG. 2) to a second position 29 about rim 27. If flange 36 is not repositioned from first position 28, then a proper seal between valve cup assembly 40 and container 20 may not be formed, which can lead to undesirable leakage of a product after it is charged into liner 30.

Figure 6A:
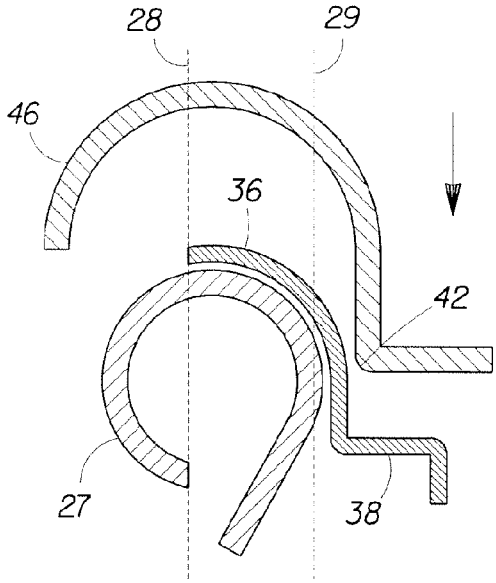
FIGS. 6A-6C are partial cross-sectional views illustrating the interaction of the valve cup sub-assembly of FIG. 4 with the liner of FIG. 3, along with the resulting repositioning of the liner.
Figure 6B:
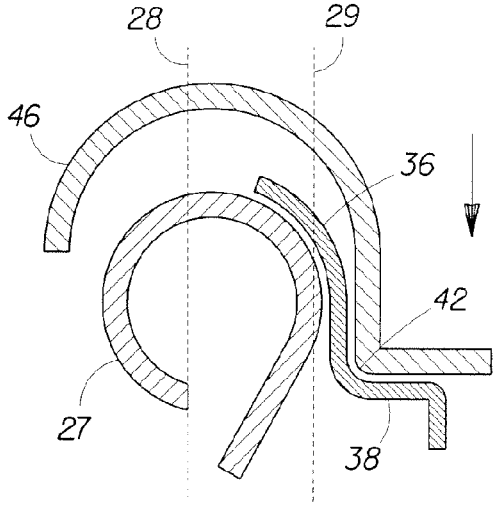
Figure 6C:
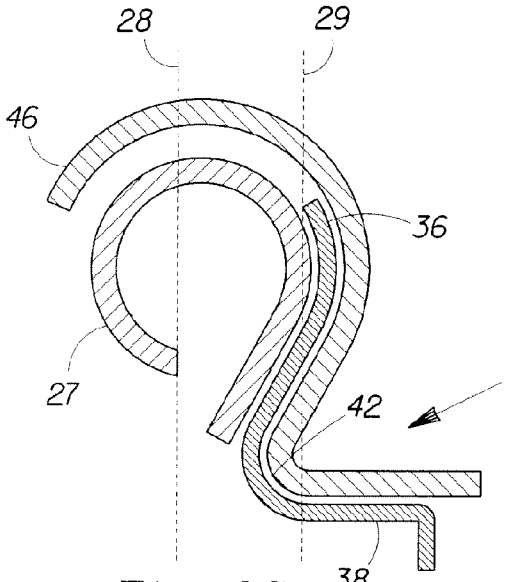

FIGS. 6A-6C illustrate the repositioning of the liner flange 36 during insertion of the valve cup assembly 40 into container 20. In FIG. 6A, liner flange 36 is located at its initial position 28 on the container rim 27, and valve cup bottom 42 is located just above shoulder 38. In FIG. 6B, valve cup bottom 42 has contacted shoulder 38 and accordingly has moved liner flange 36 from its initial position 28 about container rim 27. FIG. 6C shows cup flange 46 adjacent to rim 27, with liner flange 36 repositioned to the second position 29 about container rim 27.

Repositioning the liner flange before or while a valve cup assembly is being joined with the aerosol package container is an important aspect of the present invention. Employing a shoulder or other radially extending member in the neck region of the liner is one technique provided herein for accomplishing this repositioning aspect. Such a radially extending member may be substantially continuously disposed about the circumference of the liner neck, or alternatively be defined by a plurality of discrete members, such as, for example, a plurality of protuberances or indentations. The radially extending member may extend inward, outward, or both. The liner neck could also be tapered (non-parallel walls) such that the neck is effectively radially extending when viewed along its length. Alternatively (or in addition to), the valve cup may employ a radially extending member that contacts or otherwise engages the liner sufficiently to reposition the liner flange.

In another embodiment, the valve cup and liner are sized so that an interference is created between them that is sufficient to reposition the liner flange upon inserting the valve cup assembly into the container opening. In this embodiment, the valve cup and the liner may or may not employ a radially extending member.

In yet another embodiment, the valve stem is sized and configured to contact the liner when the valve cup assembly is joined with the container. For example, the valve stem may be lengthened to a point wherein the end of the valve stem contacts the closed bottom of the liner causing the liner as a whole to shift downward, including the liner flange resting on the container rim. The valve assembly can then be sealed to the container with the liner flange repositioned to a lower position, so that a proper seal can be realized.

The liner flange may optionally employ features that aid in its repositioning. For example, the liner flange may be discontinuously formed, wherein the flange is defined by a plurality of spaced apart flange members. The flange may also employ slits, scores, or other weakening features to aid in its repositioning. Such features may be employed in the absence of a radially extending member on either of the valve cup or liner neck.

The type and nature of products capable of being contained by and dispensed from embodiments of the present invention are unlimited. Exemplary products include shaving compositions, antiperspirants, deodorants, cleansers, hair care compositions, skin care compositions, and foods. Other products are equally contemplated herein.

Shaving compositions is one preferred product type that is suitable for use with the present invention. The shaving compositions can take various forms, including, for example, aerosol foams, and self-foaming lotions or gels.

Exemplary shaving compositions comprise, in percent by weight, from about 60% to about 93% of water, from about 2% to about 25% of a water dispersible (or soluble) surface active agent, from about 0.005% to about 2% of a lubricious water soluble polymer, from about 0.0005% to about 3% of a hydrogel-forming polymer, and from about 1% to about 6% of a volatile post-foaming agent. Each of these components is described more fully below.

The water dispersible surface active agent is preferably one that is capable of forming a lather and may comprise a soap, an interrupted soap, a detergent, an anionic surfactant, a non-ionic surfactant or a mixture of one or more of these. The soaps include, for example, the sodium, potassium and lower alkanolamine (preferably triethanolamine) salts of C12 22, preferably C14 18, fatty acids. Typical fatty acids include lauric, myristic, palmitic and stearic acid and mixtures thereof. The preferred fatty acids are palmitic and stearic. The interrupted soaps include, for example, the sodium, potassium and lower alkanolamine (preferably triethanolamine) salts of N-fatty acyl sarcosines, wherein the fatty acyl moiety has 12 to 22, preferably 14 to 18, carbon atoms. Typical sarcosines include stearoyl sarcosine, myristoyl sarcosine, palmitoyl sarcosine, oleoyl sarcosine, lauroyl sarcosine, cocoyl sarcosine and mixtures thereof. The soaps and the interrupted soaps may be utilized in preneutralized form (i.e., as the sodium, potassium or alkanolamine salt) or in the free acid form followed by subsequent neutralization with sodium hydroxide, potassium hydroxide and/or lower alkanolamine (preferably triethanolamine). In any event, the final composition must contain sufficient base to neutralize or partially neutralize the soap component and adjust the pH to the desired level (typically between 5 and 10, more typically between 6 and 9). It is most preferred that the composition of the present invention includes a soap (e.g., triethanolamine palmitate/stearate) or an interrupted soap (e.g., triethanolamine stearoyl/myristoyl sarcosinate), or a mixture thereof.

The water dispersible surface active agent may also optionally include a non-ionic, amphoteric and/or anionic surfactant. Suitable non-ionic surfactants will typically have an HLB of 9 or more and include the polyoxyethylene ethers of fatty alcohols, acids and amides, particularly those having 10 to 20, preferably 12 to 18, carbon atoms in the fatty moiety and about 2 to 60, preferably 4 to 30, ethylene oxide units. These include, for example, Oleth 20, Steareth 21, Ceteth 20, Laureth 4 and Laureth 23. Other non-ionic surfactants include the polyoxyethylene ethers of alkyl substituted phenols, such as Nonoxynol-4 and Nonoxynol-20, fatty alkanolamides such as Lauramide DEA and Cocamide MEA, polyethoxylated sorbitan esters of fatty acids, such as Polysorbate 20, lauryl polyglucoside, sucrose laurate, and polyglycerol 8 oleate. Suitable amphoteric surfactants include, for example, the betaines and sultaines such as cocoamidopropyl betaine, coco dimethyl carboxymethyl betaine, coco sultaine and the like. Suitable anionic surfactants include, for example, the sodium, potassium, ammonium and substituted ammonium salts (such as the mono-, di- and triethanolamine salts) of C8 C22, preferably C12 C18, alkyl sulfates (e.g., sodium lauryl sulfate, ammonium lauryl sulfate), alkyl sulfonates (e.g., ammonium lauryl sulfonate), alkylbenzene sulfonates (e.g., ammonium xylene sulfonate), acyl isethionates (e.g., sodium cocoyl isethionate), acyl lactylates (e.g., sodium cocoyl lactylate) and alkyl ether sulfates (e.g., ammonium laureth sulfate). The surface active agent may typically include up to about 10%, preferably 1 to 8%, of non-ionic, amphoteric and/or anionic surfactants.

Exemplary lubricious water soluble polymers will generally have a molecular weight greater between about 300,000 and 15,000,000 daltons, preferably more than about one million daltons, and will include a sufficient number of hydrophilic moieties or substituents on the polymer chain to render the polymer water soluble. The polymer may be a homopolymer, copolymer or terpolymer. Examples of suitable lubricious water soluble polymers include polyethylene oxide, polyvinylpyrrolidone, and polyacrylamide. A preferred lubricious water soluble polymer comprises polyethylene oxide, and more particularly a polyethylene oxide with a molecular weight of about 1 to about 5 million daltons. Particularly suitable polyethylene oxides include, for example, PEG 23M (MW≈1 million), PEG 45M (MW≈2 million) and PEG 90M (MW≈4 million).

The hydrogel-forming polymer may be a highly hydrophilic polymer that, in water, forms organized three-dimensional domains of approximately nanometer scale. The hydrogel-forming polymer generally has a molecular weight greater than about one million daltons (although lower molecular weights are possible) and typically is at least partially or lightly crosslinked and may be at least partially water insoluble, but it also includes a sufficient number of hydrophilic moieties so as to enable the polymer to trap or bind a substantial amount of water within the polymer matrix and thereby form three-dimensional domains. It has been found that shave gel compositions that include the hydrogel-forming polymer have improved gel structure and reduced coefficient of friction (i.e., increased lubricity). Examples of suitable hydrogel-forming polymers include a polyacrylic acid or polymethacrylic acid partially esterified with a polyhydric alcohol; hydrophilic polyurethanes; lightly crosslinked polyethylene oxide; lightly crosslinked polyvinyl alcohol; lightly crosslinked polyacrylamide; hydrophobically modified hydroxyalkyl cellulose; hydroxyethyl methacrylate; and crosslinked hyaluronic acid.

An exemplary hydrogel-forming polymer comprises polyacrylic acid partially esterified (e.g., about 40% to 60%, preferably about 50%, esterified) with glycerin. Such a polymer includes glyceryl acrylate/acrylic acid copolymer (MW>one million). It is believed that the glyceryl acrylate/acrylic acid copolymer forms a clathrate that holds water, which, upon release supplies lubrication and moisturization to the skin. A preferred source of glyceryl acrylate/acrylic acid copolymer is available from ISP Technologies, Inc. (United Guardian Inc.) under the tradename Lubrajel®, particular the form known as Lubrajel® oil which contains about 1.0%-1.3% glyceryl acrylate/acrylic acid copolymer in aqueous glycerin (~40% glycerin). Lubrajel® oil also includes about 0.6% PVM/MA copolymer (also known as methoxyethylene/maleic anhydride copolymer), which may further contribute to the lubricity of this source.

The post-foaming agent may be any volatile hydrocarbon or halohydrocarbon with a sufficiently low boiling point that it will volatilize and foam the gel upon application to the skin, but not so low that it causes the gel to foam prematurely. The typical boiling point of such an agent generally falls within the range of 20° C. to 40° C. Preferred post-foaming agents are selected from saturated aliphatic hydrocarbons having 4 to 6 carbon atoms, such as n pentane, isopentane, neopentane, n butane, isobutane, and mixtures thereof. Most preferred is a mixture of isopentane and isobutane in a weight ratio (IP:IB) of about 1:1 to about 9:1, preferably about 2:1 to about 7:1, most preferably about 3:1. The post-foaming agent will normally be selected so as to provide a vapor pressure at 20° C. of about 3 to about 20 psig, preferably about 5 to about 15 psig. The post-foaming agent will be present in an amount to provide the shaving composition with a sufficiently rapid turnover that is, transition from gel to foam when contacted with the skin typically, in about 2 to about 30 seconds, preferably in about 5 to about 15 seconds.

Although not necessary to forming a useful shaving composition, other cosmetic ingredients may be advantageously added to improve the application aesthetics and/or achieve other shave benefits. For example, the shaving composition may include one or more of the following components: wetting agents, skin conditioning agents (e.g., vitamins A, C and E, aloe, allantoin, panthenol, alpha-hydroxy acids, phospholipids, triglycerides, botanical oils, amino acids), foam boosters, emollients, humectants (e.g., glycerin, sorbitol, propylene glycol), fragrances, colorants, antioxidants, preservatives, etc.

It may be advantageous to include a sorbitan fatty ester or a sucrose fatty ester, typically in an amount of about 0.1% to about 3%, preferably about 0.3% to about 2%, by weight. These materials have multifunctional properties of emulsifier, moisturizer and anti-irritant. Sorbitan fatty esters include sorbitan stearate, sorbitan oleate, sorbitan isostearate, sorbitan laurate, sorbitan dioleate, etc. Sucrose fatty esters include sucrose stearate, sucrose oleate, sucrose isostearate, sucrose cocoate, sucrose distearate, etc. The sorbitan esters and sucrose esters may be mixtures of mono-, di- and tri-esters.

It may also be desirable to include an ester of a fatty acid, typically in an amount of about 0.5% to about 5%, preferably about 1% to about 4%, by weight. Useful fatty esters include glyceryl fatty esters such as, for example, glyceryl oleate and glyceryl dioleate, and fatty alcohol esters such as, for example, isostearyl linoleate, isocetyl oleate, and isostearyl isostearate. These materials provide emolliency, lubrication and gel structure.

It may further be desirable to include a propoxylated fatty amide, typically in an amount of about 0.5% to about 5%, preferably about 1% to about 3%, by weight. The propoxylated fatty amide will typically have from 1 to 3 propoxyl groups attached to a hydroxyloweralkyl fatty amide. Thus, suitable propoxylated fatty amides include, for example, PPG 2-hydroxyethyl coco/isostearamide, PPG 3-hydroxyethyl linoleamide, and PPG 2-hydroxyethyl cocamide.

The shaving composition may include a water-soluble gelling aid or thickening agent to improve its consistency and stability, as well as to adjust its viscosity. These may include, for example, hydroxyalkyl cellulose polymers such as hydroxyethyl cellulose and hydroxypropyl cellulose (sold under the trademarks "Natrosol" and "Klucel" respectively), PEG-150 distearate, carboxymethyl cellulose, and cellulose methyl ether (sold under the trademark "Methocel"). Other suitable materials include the polysaccharide gums such as, for example, xanthan gum, carrageenan gum, guar gum, locust bean gum, and hydroxypropyl guar gum.

The present invention is also directed to methods for assembling aerosol packages, such as, for example, those described above. One exemplary embodiment includes the following steps: (a) providing a sub-assembly comprising an aerosol container and a liner disposed therein, i) the aerosol container comprising an opening on one end that is defined by a circumferentially extending wall and a rim disposed at a distal portion thereof; ii) the liner comprising a liner body, a liner neck extending from the liner body, and a liner flange disposed about a distal portion of the liner neck, wherein the liner neck is disposed adjacent or radially inward of the circumferentially extending wall and the liner flange is disposed at a first position about the rim; (b) providing a valve cup comprising a cup bottom and a cup top, and a valve cup flange extending from the cup top; (c) displacing the liner flange away from the first position about the rim; (d) inserting the valve cup into the liner and the aerosol container opening; and (e) joining the valve cup flange with the aerosol container rim.

The step of displacing the liner flange away from the first position about the container rim (step (c)) may be accomplished through design features that are described elsewhere in the instant specification. In this manner, performing step (d) accomplishes the performance of step (c).

Alternatively, the step of displacing the liner flange may be accomplished through application of a force that is independent from (or in addition to) that imparted by the valve cup upon its insertion into the container. For example, a tool may be used to reposition the flange liner before and/or while the valve cup is inserted. Pressurized air may also be used to reposition the flange liner. Other techniques for applying force to the flange liner can equally be employed within the spirit of the present invention.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aerosol package, comprising:

(a) an aerosol container comprising a first closed end and an opposing second end, the opposing second end comprising a circumferentially extending wall and a terminally positioned rim defining an opening;

(b) a liner disposed within the aerosol container, the liner comprising a liner body and a liner neck extending from the liner body, the liner neck comprising a radially extending member and a flange; and (c) a valve cup disposed within the liner neck, the configuration of the valve cup, the liner neck, and the terminally positioned rim are such that:

(1) in a first position, before the valve cup is inserted into the opening, said flange of said liner neck rests on said terminally positioned rim; and (2) in a second position when said valve cup is inserted into the opening of said opposing second end, the cup contacts the radial expending member, whereby said flange is repositioned to expose a portion of said terminally positioned rim and said exposed portion of said terminally positioned rim and said valve cup form a seal.

2. The aerosol package of claim 1, wherein the radially extending member is a shoulder defined in the liner neck.

3. The aerosol package of claim 1, wherein the radially extending member is substantially continuously disposed about the circumference of the liner neck.

4. The aerosol package of claim 1, wherein the valve cup comprises a cup bottom which contacts the radially extending member in the second position.

5. The aerosol package of claim 1, further comprising a shaving composition contained within the liner.

6. The aerosol package of claim 1, wherein the radially extending member extends inward from the liner flange.

7. The aerosol proposal of claim 1, wherein the liner flange extends circumferentially around the circumference of the liner neck.

* * * * *